US008337037B2

(12) United States Patent
Hopkins

(10) Patent No.: US 8,337,037 B2
(45) Date of Patent: Dec. 25, 2012

(54) MOUNTING BRACKET

(75) Inventor: Larry D. Hopkins, Oklahoma City, OK (US)

(73) Assignee: Larry D. Hopkins, Oklahoma City, OK (US), Trustee ( * ) Notice: Subject to any disclaimer, the term of this patent is extended or adjusted under 35 U.S.C. 154(b) by 458 days.

(21) Appl. No.: 12/690,770

(22) Filed: Jan. 20, 2010

(65) Prior Publication Data

US 2011/0176319 A1 Jul. 21, 2011

(51) Int. Cl.
*F21V 21/00* (2006.01)

(52) U.S. Cl. ..... 362/150; 362/148; 362/404

(58) Field of Classification Search ..... 362/404, 362/147, 148, 150; 248/220.21, 225.21
See application file for complete search history.

(56) References Cited

U.S. PATENT DOCUMENTS

| | | | | |
|---|---|---|---|---|
| 2,487,708 | A * | 11/1949 | Henry | 472/124 |
| 5,873,556 | A * | 2/1999 | Reiker | 248/323 |
| 6,708,940 | B2 * | 3/2004 | Ligertwood | 248/324 |
| 7,033,048 | B2 * | 4/2006 | Sin | 362/404 |
| 2007/0147053 | A1 * | 6/2007 | Gagne et al. | 362/404 |

FOREIGN PATENT DOCUMENTS

SU 541736 A * 3/1977

* cited by examiner

*Primary Examiner* — Laura Tso
(74) *Attorney, Agent, or Firm* — Dunlap Codding, P.C.

(57) ABSTRACT

A bracket assembly for suspending an object from a portion of a bar joist, the bracket assembly having a rigid hangar having a first end portion and an opposing second end portion, the second end portion including at least one connector for engaging the object and means for connecting the rigid hanger to the bar joist, the first end portion of the rigid hangar being pivotally connected to the connecting means so that the object connected to the rigid hangar is able to self-level upon the connecting means being connected to the bar joist.

16 Claims, 16 Drawing Sheets

MOUNTING BRACKET

BACKGROUND OF THE INVENTION

1. Field of the Invention

This invention relates to a mounting bracket, and more particularly, but not by way of limitation, to a mounting bracket for use with lighting fixtures, for example, high intensity fluorescent lighting assemblies.

2. Brief Description of Related Art

High intensity fluorescent lighting, or "HIF lights" are relatively new in the art. HIF lights are provided for producing intense light in a small area and are considered "point sources" of lighting. HIF lights are popular in applications that feature large expanses lit by distant fixtures, such as indoor and outdoor sports facilities, factories and warehouses with high ceilings. HIF lights are beginning to replace high intensity discharge lighting, or "HID lamps" for a variety of reasons, namely HIF lights do not require long warm-up times of traditional HID lamps. Also, HIF lights are quieter and do not produce light flicker when operated. For these reasons, HIF lights are replacing HID lamps in many applications.

Most fluorescent lighting used in industrial applications requires the use of long glass tubes filled with a gas. Typically, fluorescent lighting fixtures comprise a rectangular frame that is adapted to receive one or more of the glass tubes within sockets that are connectable to an electrical energy source. As each of the glass tubes is typically four feet in length and each frame may hold multiple glass tubes, the lighting fixtures can be cumbersome to handle and install. For example, most fluorescent lighting fixtures will have a width of two feet and a length of four feet, therefore, installation is can be particularly challenging. In most cases, the fluorescent lighting fixtures are installed by suspending the fluorescent lighting fixtures from cables that hang from the ceiling of a structure. Additionally, the fluorescent lighting fixtures may be installed by securely strapping the fluorescent lighting fixtures to a structural beam of the ceiling of a structure. This method of installation is undesirable as the positioning of the fluorescent lighting fixtures depend upon the slope of the ceiling such that if the ceiling is angled, the fluorescent lighting fixtures will project light at an angle rather than directly downward.

Therefore, a need exists for a mounting bracket for suspending fluorescent lighting fixtures or other objects from the ceiling of a structure. It is to such a mounting bracket that the present invention is directed.

BRIEF DESCRIPTION OF THE SEVERAL VIEWS OF THE DRAWINGS

FIG. 6 is an exploded perspective view of the bracket assembly shown in combination with an extension member and a lighting fixture.

DETAILED DESCRIPTION OF EXEMPLARY EMBODIMENTS

Figure 1:
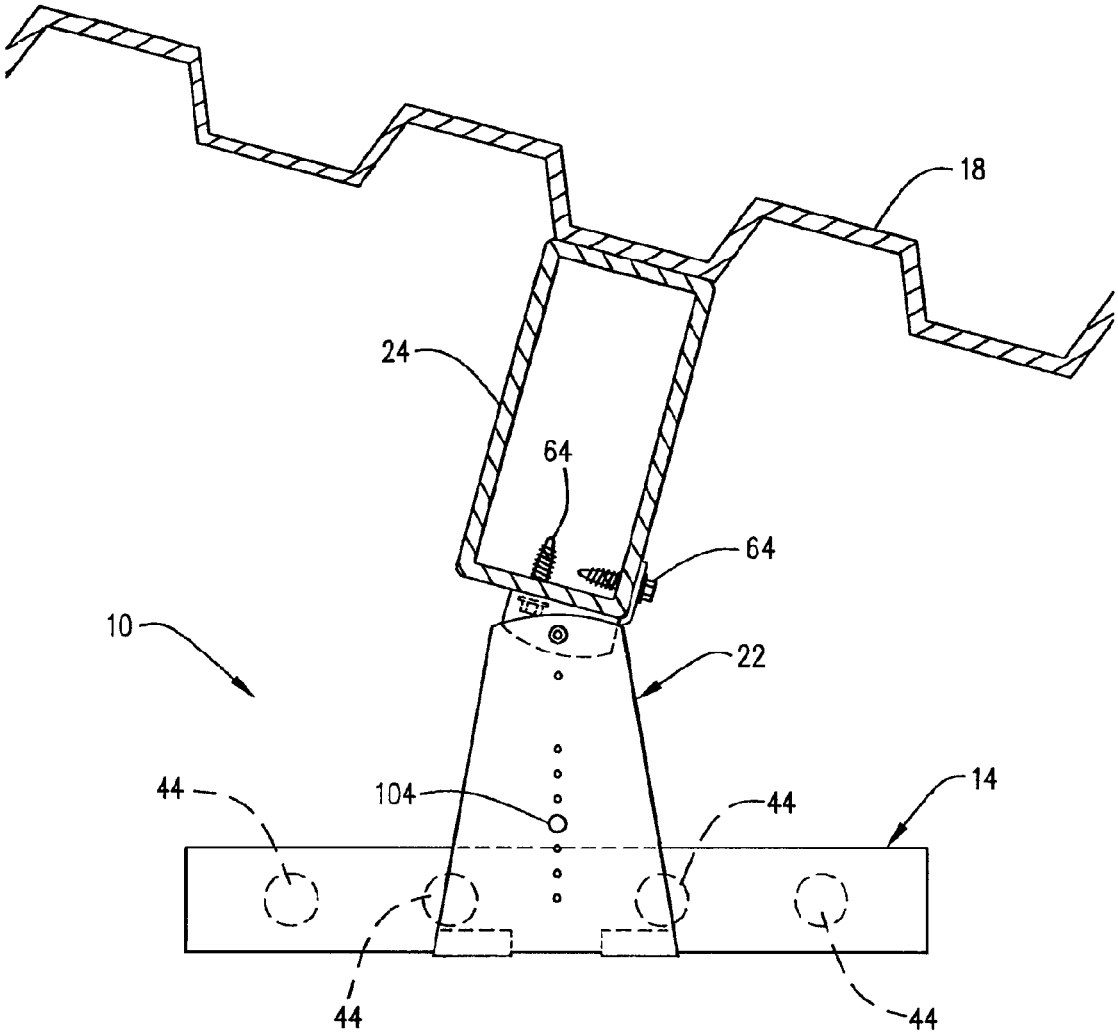
FIG. 1 is an end view of a bracket assembly constructed in accordance with the present invention shown connected to a support beam of a ceiling for securing a fluorescent lighting fixture.
Figure 2:
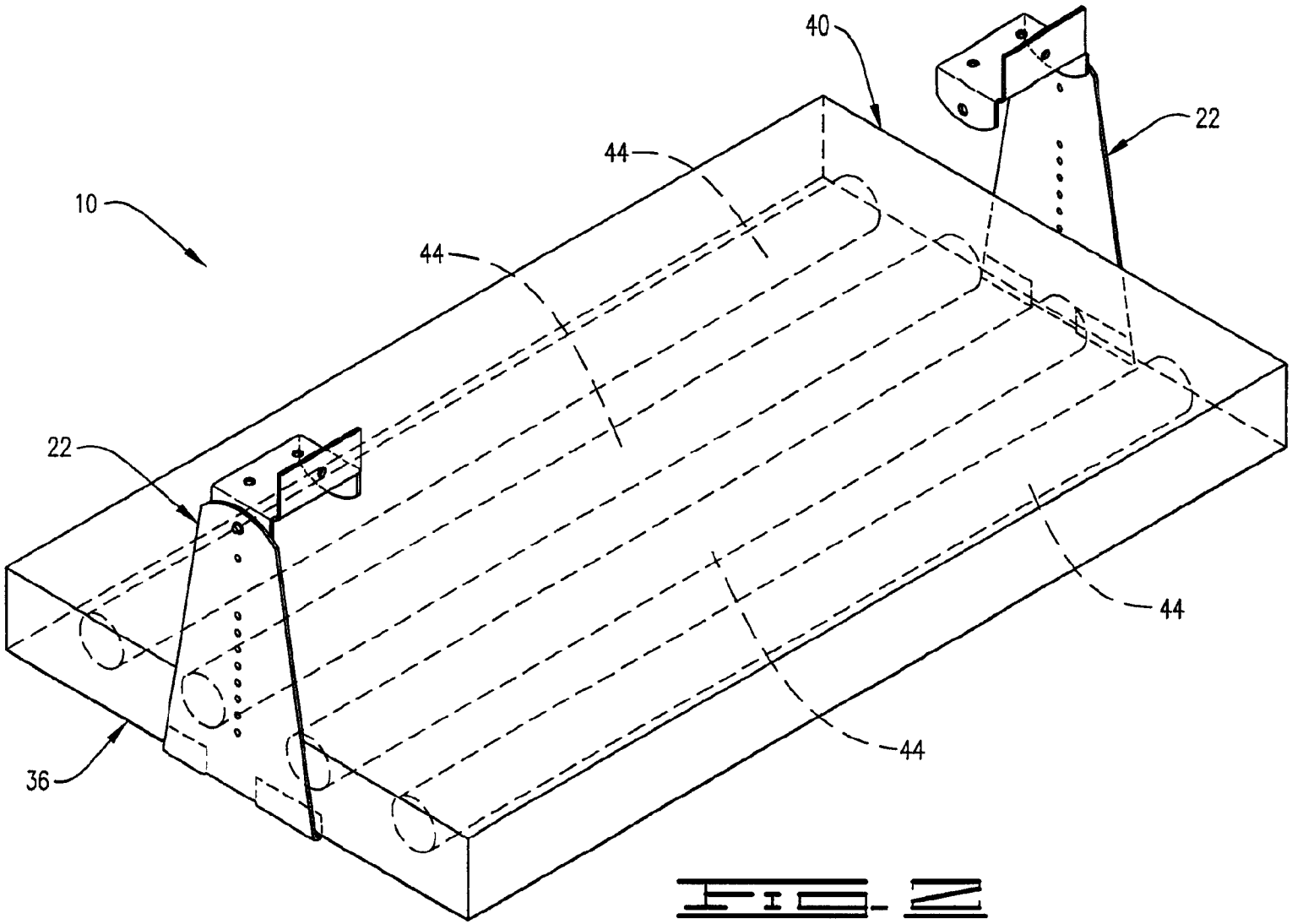
FIG. 2 is a perspective view of the bracket assembly in combination with the lighting fixture.

Referring now to the drawings and, more particularly to FIGS. 1 and 2 collectively, shown therein is a mounting bracket 10, in combination with a fluorescent lighting fixture 14. The mounting bracket 10 is connectable to a ceiling 18 of a structure, and more specifically to a support beam 24 of the ceiling 18. The support beam 24 is typically fabricated of steal, but may be fabricated on other material, such as concrete. The mounting bracket 10 is constructed in such a way that when connected to the lighting fixture 14, the lighting fixture 14 may self-level so that the lighting fixture 14 is disposed substantially parallel to the ground of the structure when the ground is level.

The lighting fixture 14 is provided with a substantially rectangular frame 32 having a first end 36 and a second end 40 and a length extending therebetween. Although the lighting fixture 14 has been disclosed as having a substantially rectangular frame 32, any number of other shapes and/or configurations of lighting fixtures 14 which would be known to one of ordinary skill in the art with the present disclosure before them are likewise contemplated for use in accordance with the present invention. The lighting fixture 14 also includes one or more fluorescent tube lights 44 in electrical connection with an electrical connector (not shown) for connecting the lighting fixture 14 to the electrical system of the structure.

The mounting bracket 10 may include one or more bracket assemblies 22. The bracket assemblies 22 are constructed identically to one another. For purposes of brevity, the construction of only one of the bracket assemblies 22 will be described hereinafter. The bracket assembly 22 may be constructed from a strong and rigid material such as a metal (such as steel, titanium, aluminum or blends thereof), although any number of materials, for example, a resin or plastic polymer, natural material(s) such as a wood or fiber based material and combinations thereof, that would be known to one of ordinary skill in the art with the present disclosure before them are likewise contemplated for use in accordance with the present invention. The bracket assembly 22 may be fabricated using any number of different manufacturing processes, the selection of which may be controlled, in part, by the material selected.

Figure 3:
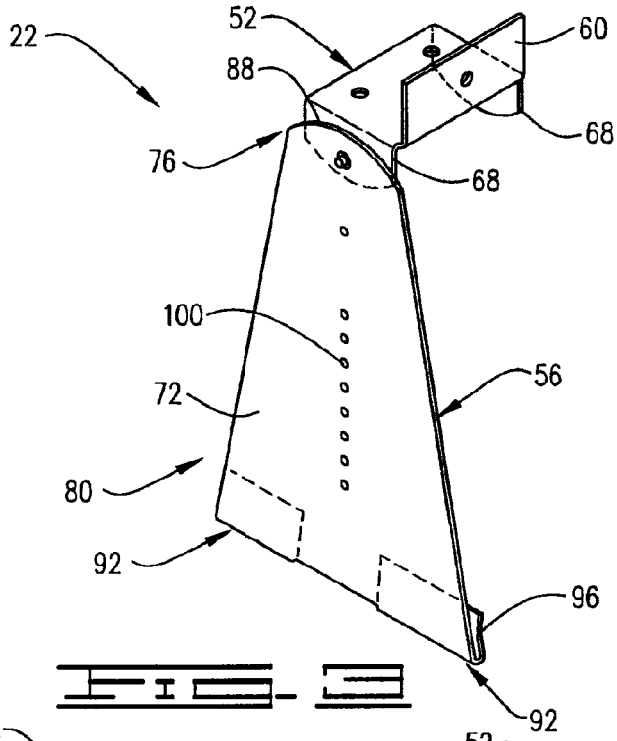
FIG. 3 is a perspective view of the bracket assembly.
Figure 4:
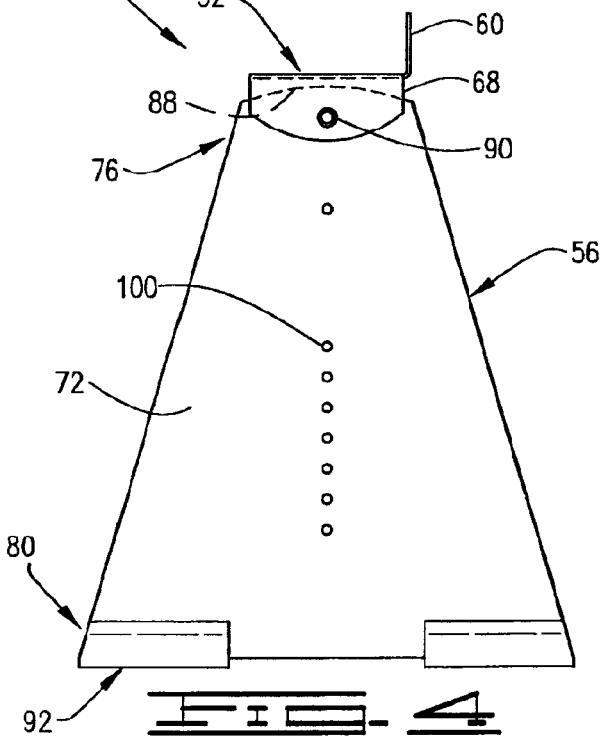
FIG. 4 is an end view of the bracket assembly.
Figure 5:
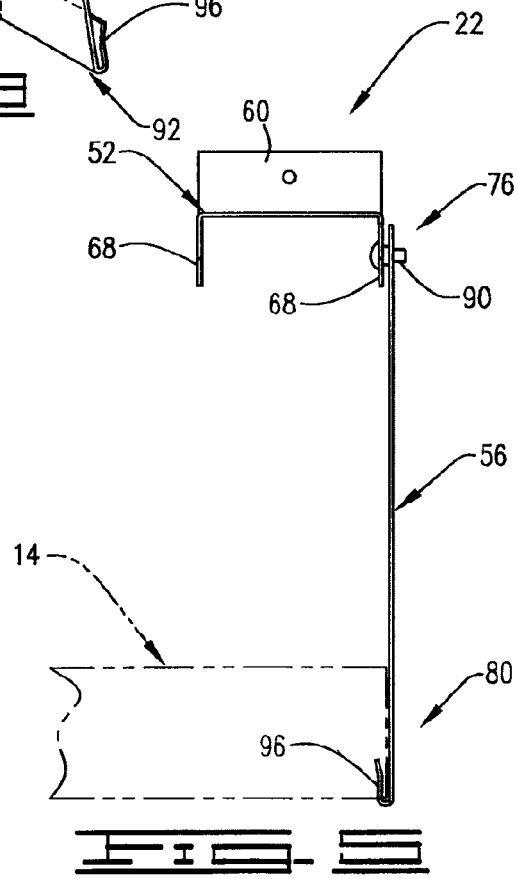
FIG. 5 is an elevation view of the bracket assembly.
Figure 5:
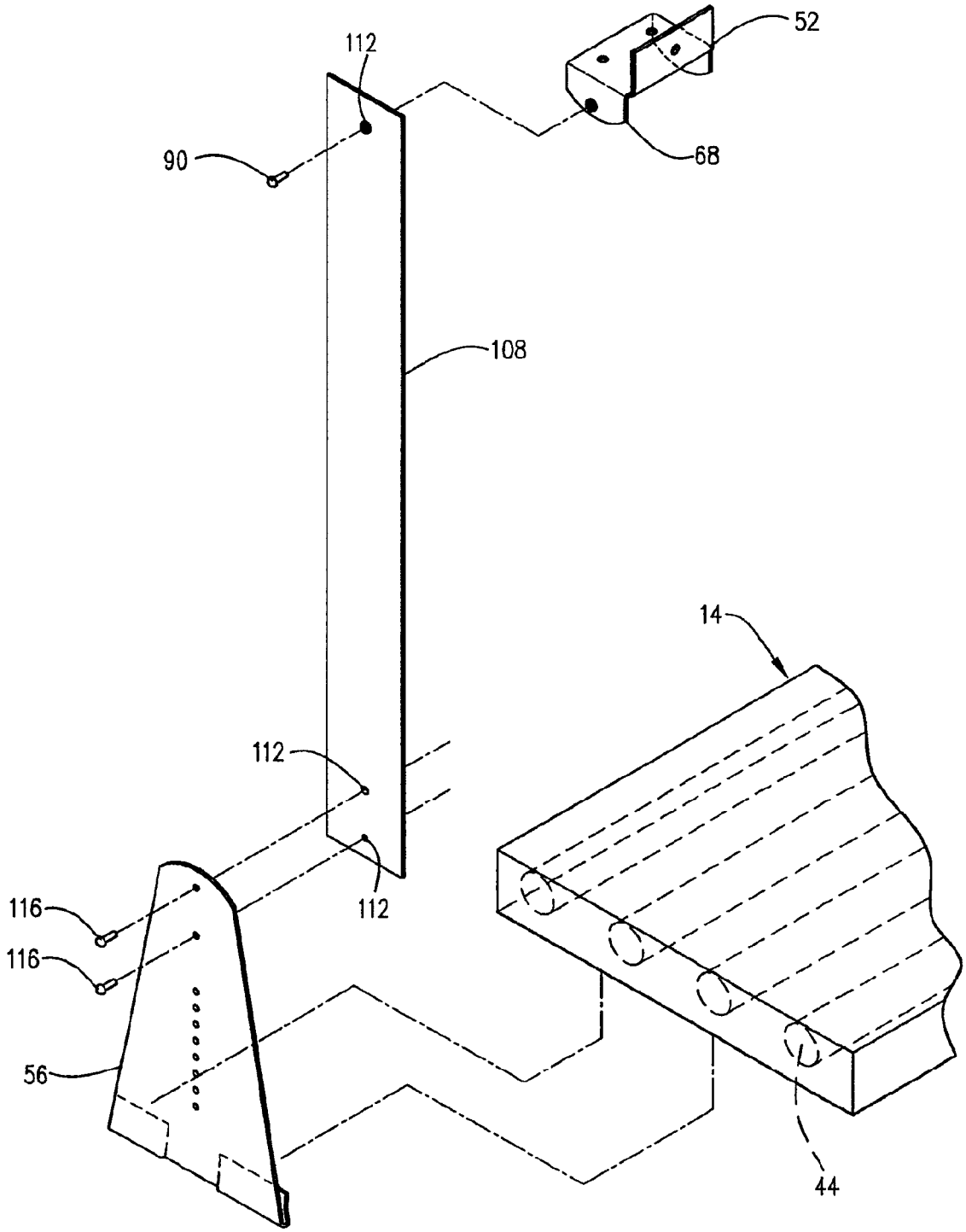

Referring now to FIGS. 3-5, the bracket assembly 22 includes a connector member 52 and a hangar 56. It will be understood that each bracket assembly 22 includes a connector member 52 and a hangar 56. The connector member 52 is provided as a substantially L-shaped portion 60 constructed to conform to at least a portion of the support beam 24 of the ceiling 18 such that the L-shaped portion 60 may be connected to the support beam 24 of the ceiling 18 (see FIG. 1). Although the connector member 52 has been disclosed as being L-shaped, any number of other shapes and/or configurations, as well as sizes, which allow the connector member 52 to join with the support beam 24 of the ceiling 18 are likewise contemplated for use in accordance with the present invention. The L-shaped portion 60 is connectable to the support beam 24 via one or more fasteners 64 (also see FIG. 1), for example, threaded fasteners, nut and bolt fasteners, clips, adhesives, straps, rivets, concrete anchors, and/or combinations thereof.

The connector member 52 further includes at least one, but preferably two, downwardly extending flanges 68. It will be understood that the inclusion of two flanges 68 allows the connector member 52 to be used in both a right handed and left handed fashion, making the bracket assembly 22 universal. The flanges 68 are provided to pivotally connect the connector member 52 to the hangar 56 as will be discussed in greater detail below.

In one embodiment, the hangar 56 is an elongated, rigid plate 72. The plate 72 includes a first end portion 76, a second end portion 80, and a length extending therebetween. The first end portion 76 is provided with a substantially rounded edge 88 which allows the hangar 56 to pivotally connect to one of the flanges 68 of the connection member 52 without interfering with the support beam 24 during rotation of the hangar 56. Although the hangar 56 has been shown as being A-shaped, any number of other shapes and/or configurations (e.g., rectangular, square, elliptical, or irregular) which would be known to one of ordinary skill in the art with the present disclosure before them are likewise contemplated for use in accordance with the present invention.

In one embodiment, the first end portion 76 of the hangar 56 is pivotally connected to the connector member 52 by a pin fastener 90. It will be understood that other types of connections and/or fasteners which allow the hangar 56 to pivot while being securely connected to the connector member 52, for example, rivets, a threaded fastener, a clip or the like are likewise contemplated for use in accordance with the present invention.

The second end portion 80 of the plate 72 includes one or more connectors 92 for securing a portion of the lighting fixture 14 to the hangar 56. In one embodiment, the one or more connectors 92 includes two upturned tabs 96 forming substantially V-shaped grooves for slidingly receiving at least a portion of one of the first and the second ends 36 and 40 of the rectangular frame 32 of the lighting fixture 14 such that one of the hangars 56 is connected to the first end 36 of the lighting fixture 14 and the other hangar 56 is connected to the second end 36 of the lighting fixture 14. Although the connectors 92 have been disclosed as being upturned tabs 96 forming substantially V-shaped grooves, any number of differently shaped tabs or components that function to join the rectangular frame 32 of the lighting fixture 14 to the hangars 56 are likewise contemplated for use in accordance with the present invention.

In one embodiment of the present invention, the hangar 56 includes one or more apertures 100 disposed longitudinally along the midline of the of the hangar 56. It will be understood that the apertures 100 may be located at any position along the plate 72. The apertures 100 are sized to receive a securement member 104 (see FIG. 1) therethrough to act as a stop to prevent the lighting fixture 14 from disassociating from the hangar 56. Examples of various securement members 104 include, but are not limited to, threaded members, pins, clips, rivets and the like. The securement member 104 is preferably inserted into an aperture 100 that is located above the top of the frame 32 of the lighting fixture 14 when the lighting fixture 14 is joined with the bracket assembly 22 (see FIG. 1).

Referring now to FIG. 6, the bracket assembly 22 may also include an extension member 108 for increasing the distance between the flanges 68 and the hangars 56. The extension member 108 may include any number of shapes and/or sizes, for example, in one embodiment, the extension member 108 includes an elongated plate having apertures 12 fabricated into both ends of the plate. Each of the two lower apertures 112 (proximate to the hangar 56) are fabricated to receive a fastener 116 therethrough for securing the hangar 56 to the extension member 108. Also, the extension member 108 is connected to one of the flanges 68 of the hangar 56 by the pin fastener 90 which allows the extension member 108 to pivot relative to the connector member similar to the pivotal connection of the hangar 56 as disclosed above. The extension member 108 allows the lighting fixture 14 to hang further down from the ceiling 18 and also provides a clearance between the ceiling 18 and the lighting fixture 14 to facilitate maintenance on the lighting fixture 14.

To install the lighting fixture 14 using the mounting bracket 10, each of the bracket assemblies 22 is secured to the support beam 24 of the ceiling spaced apart from one another. More specifically, the bracket assemblies 22 are spaced apart a distance substantially equal to the length of the frame 32 of the light fixture 14. The connector members 52 are connected to the support beam 24 by placing the connector member 52 in a mating relationship with the support beam 24 and attaching the connector members 52 with fasteners 64. With the bracket assemblies 22 secured to the support beam 24, the light fixture 14 is secured to each of the two bracket assemblies 22 by inserting the first end 36 of the frame 32 into the grooves of one of the hangars 56 of a first bracket assembly 22 and inserting the second end 40 of the frame 32 into the grooves of the other hanger 56. To further secure the lighting fixture 14 to the bracket assemblies 22, securement members 104 are placed through one of the apertures 100 of each of the hangars 56 of each of the bracket assemblies 22 at a distance above the top of the frame 32 of the lighting fixture 14 (see FIG. 1). Due to the pivotal connection between the connector members 52 and the hangers 56, the light fixture 14 will move to a substantially level orientation.

In another embodiment, certain parts of the mounting bracket 10 disclosed above are fabricated integrally, or fixedly attached together with the rectangular frame 32 to produce a self-leveling lighting fixture. For example, the hangars 56 may be fabricated as integral parts of the rectangular frame 32 such that the connector members 52 may be installed by connecting the connector members 52 to the support beam 24 and the self-leveling lighting fixture is then rotatably connected to the connector members 52 by inserting pin fasteners through the first portion 76 of the hangars 56 and the flanges 56 of the connector members 52.

Figure 7:
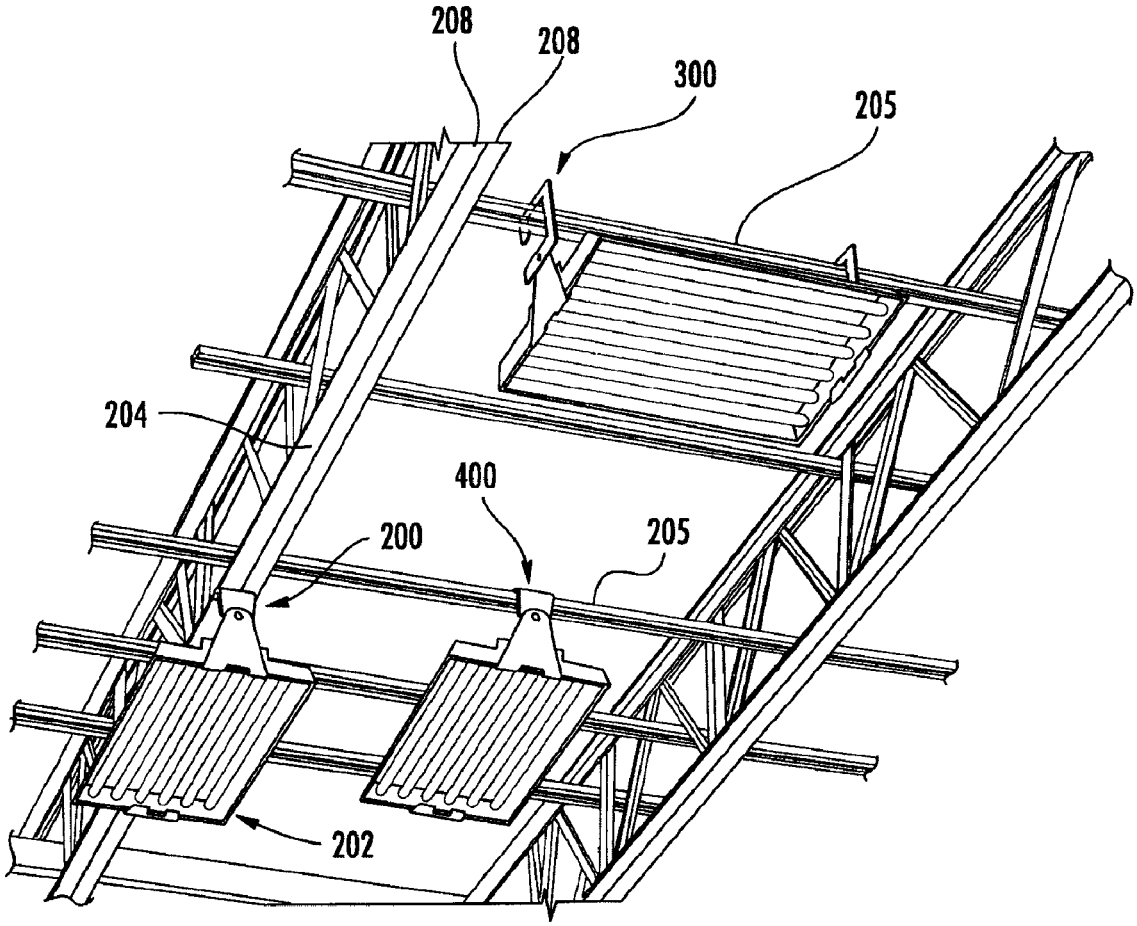
FIG. 7 is a perspective view of various embodiments of mounting brackets constructed in accordance with the present invention for suspending objects from support beams.

Referring now to FIG. 7, shown therein are a mounting bracket 200, a mounting bracket 300, a mounting bracket 400. Each of the mounting brackets 200, 300, and 400 is used for suspending an object, such as a lighting fixture 202 or signage from a bar joist 204 of a ceiling of a structure or one or more struts 205 extending between the bar joist 204. The selection of the appropriate mounting bracket 200, 300 or 400 is dependent on the desired location and orientation of the object being suspended. The struts 205 may extend in any direction along a portion, or potentially, the entire ceiling of the structure. In one embodiment, the struts 205 are disposed perpendicularly to the bar joist 204 described above. The strut 205 may be in the form of any number of different support members such as I-beams, channels, joists of varying sizes and shapes. The strut depicted herein is a channel by the Unistrut Corporation, and sold under the trademark Unistrut®.

Figure 8:
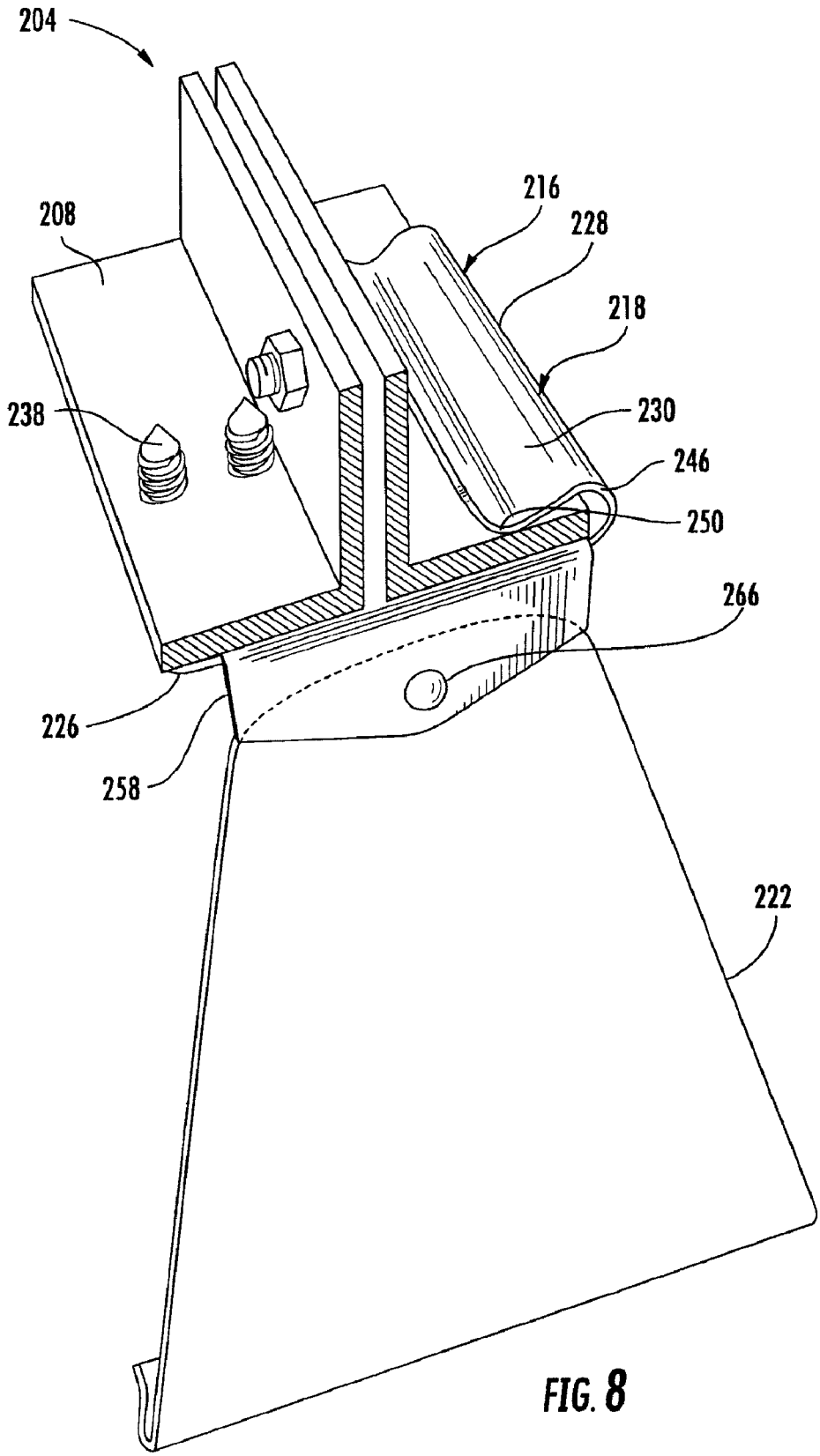
FIG. 8 is a perspective view of a bracket assembly shown connected to a portion of a bar joist.
Figure 9:
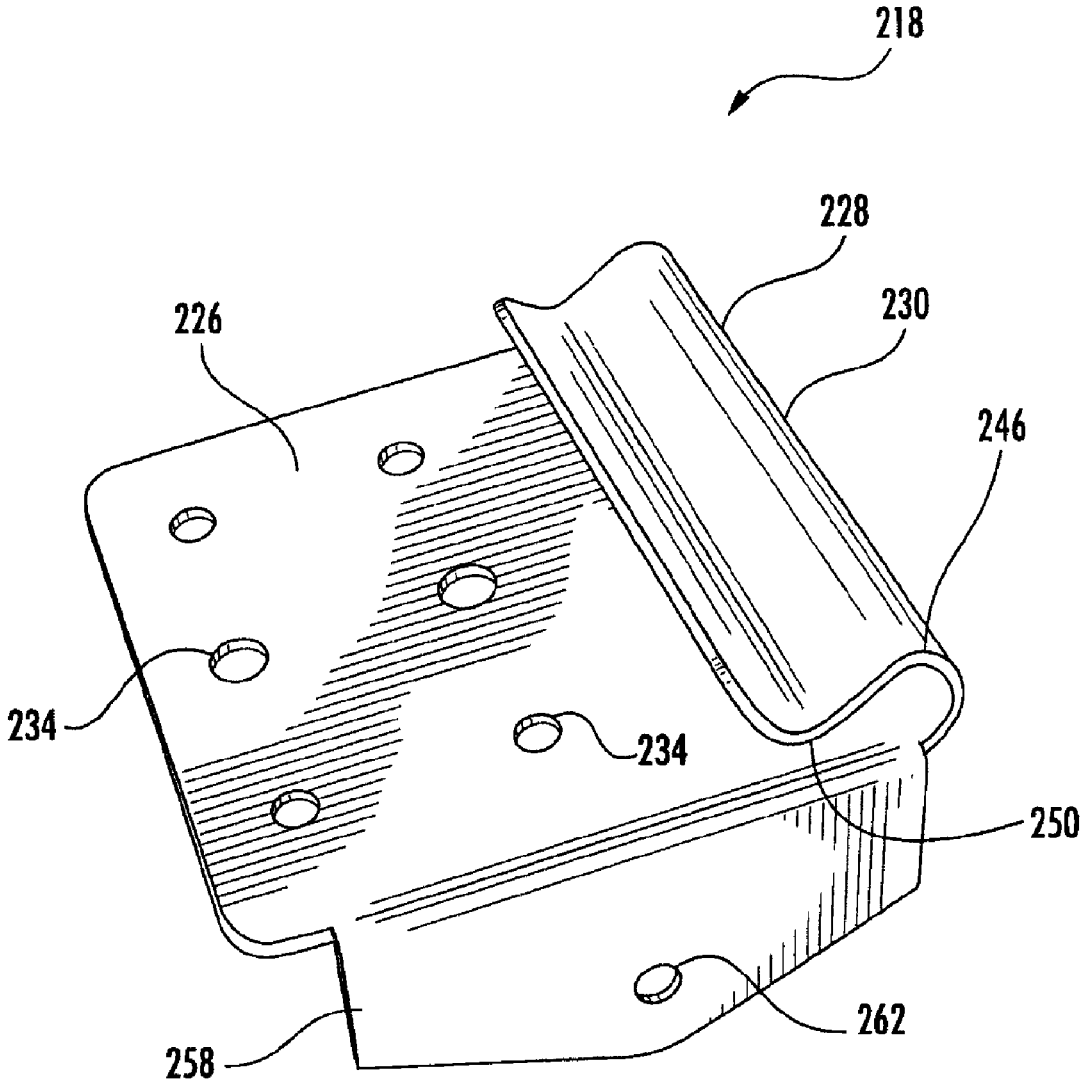
FIG. 9 is a perspective view of a connector member of the bracket assembly of FIG. 8.
Figure 10:
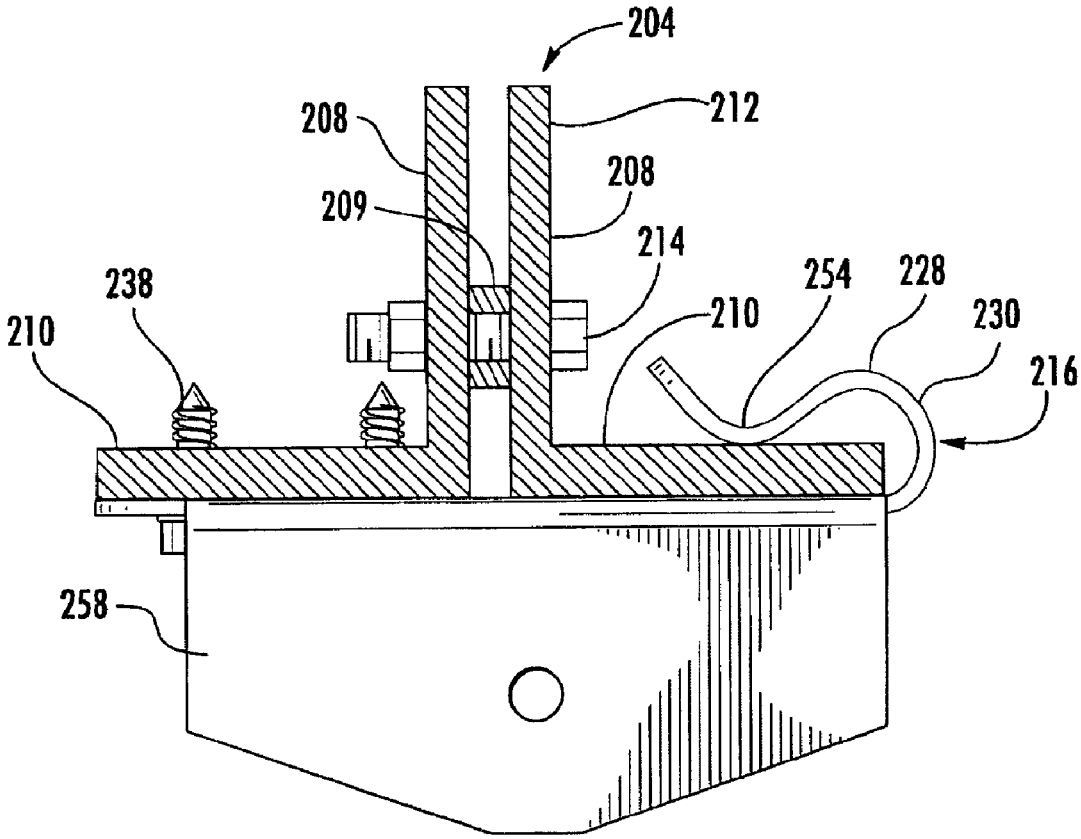
FIG. 10 is a side elevational view of the connector member of the bracket assembly shown connected to the bar joist.
Figure 11:
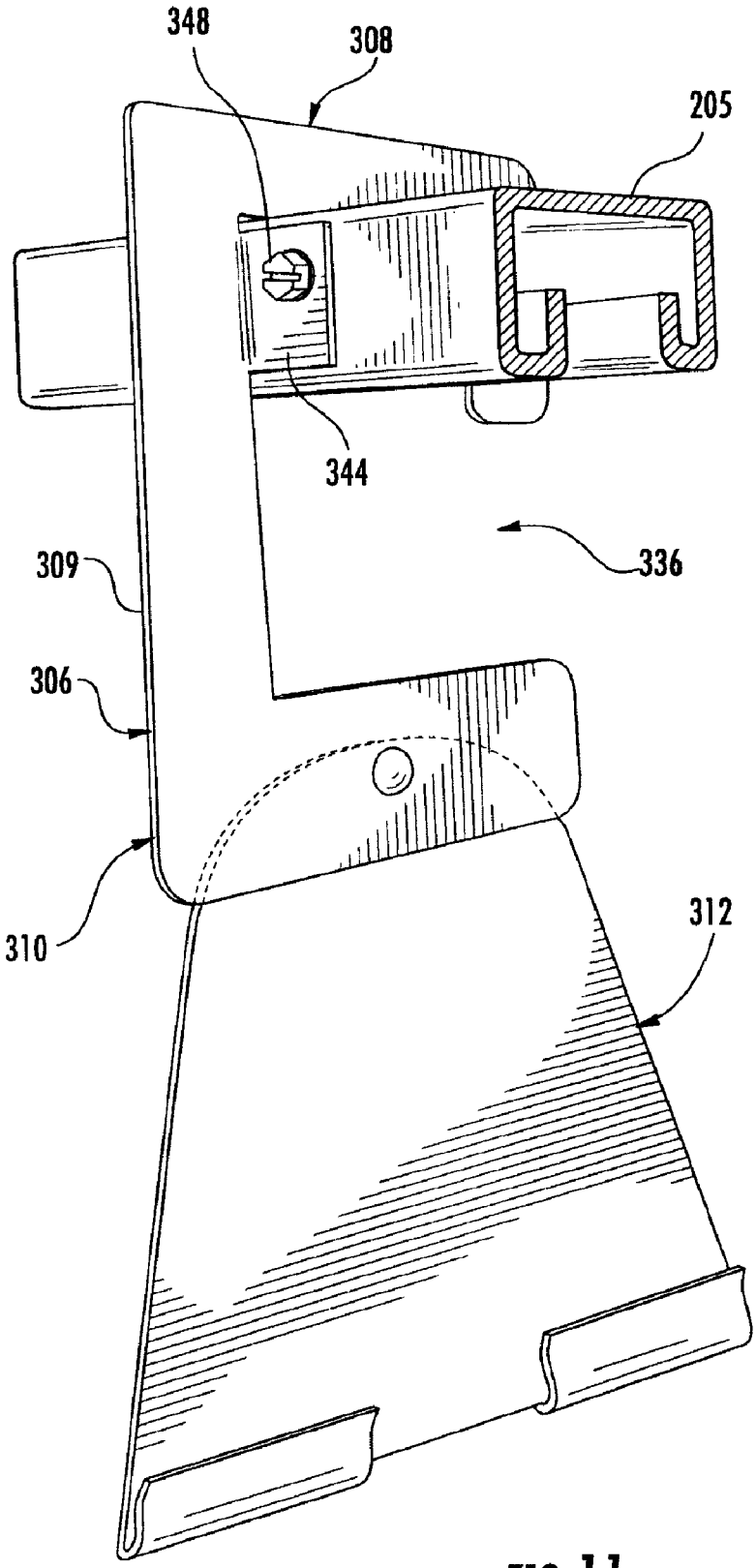
FIG. 11 is a perspective view of another embodiment of a bracket assembly constructed in accordance with the present invention shown connected to a strut.
Figure 12:
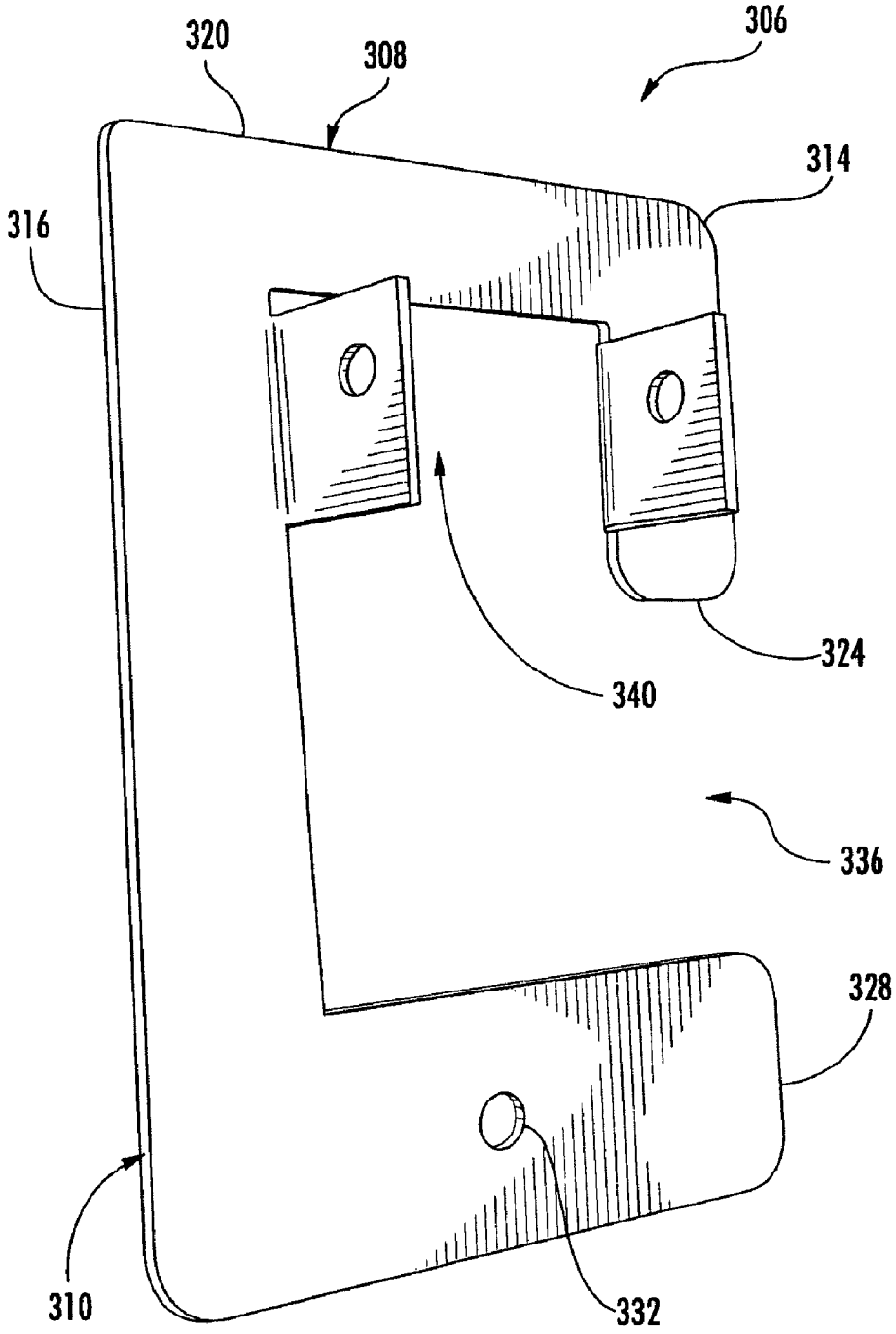
FIG. 12 is a perspective view of a connector member of the bracket assembly of FIG. 11.
Figure 13:
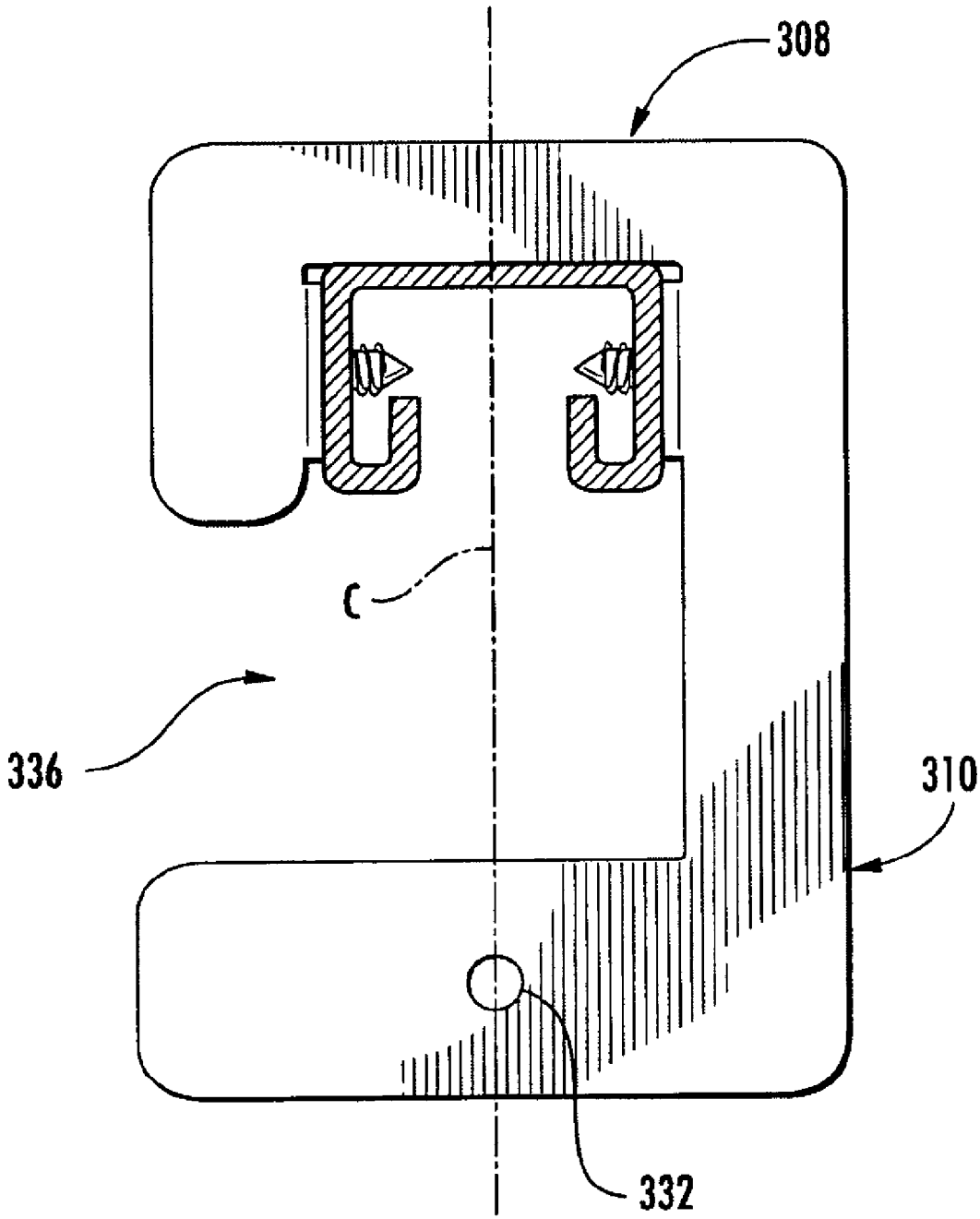
FIG. 13 is a side elevational view of the connector member shown connected to the strut.
Figure 14:
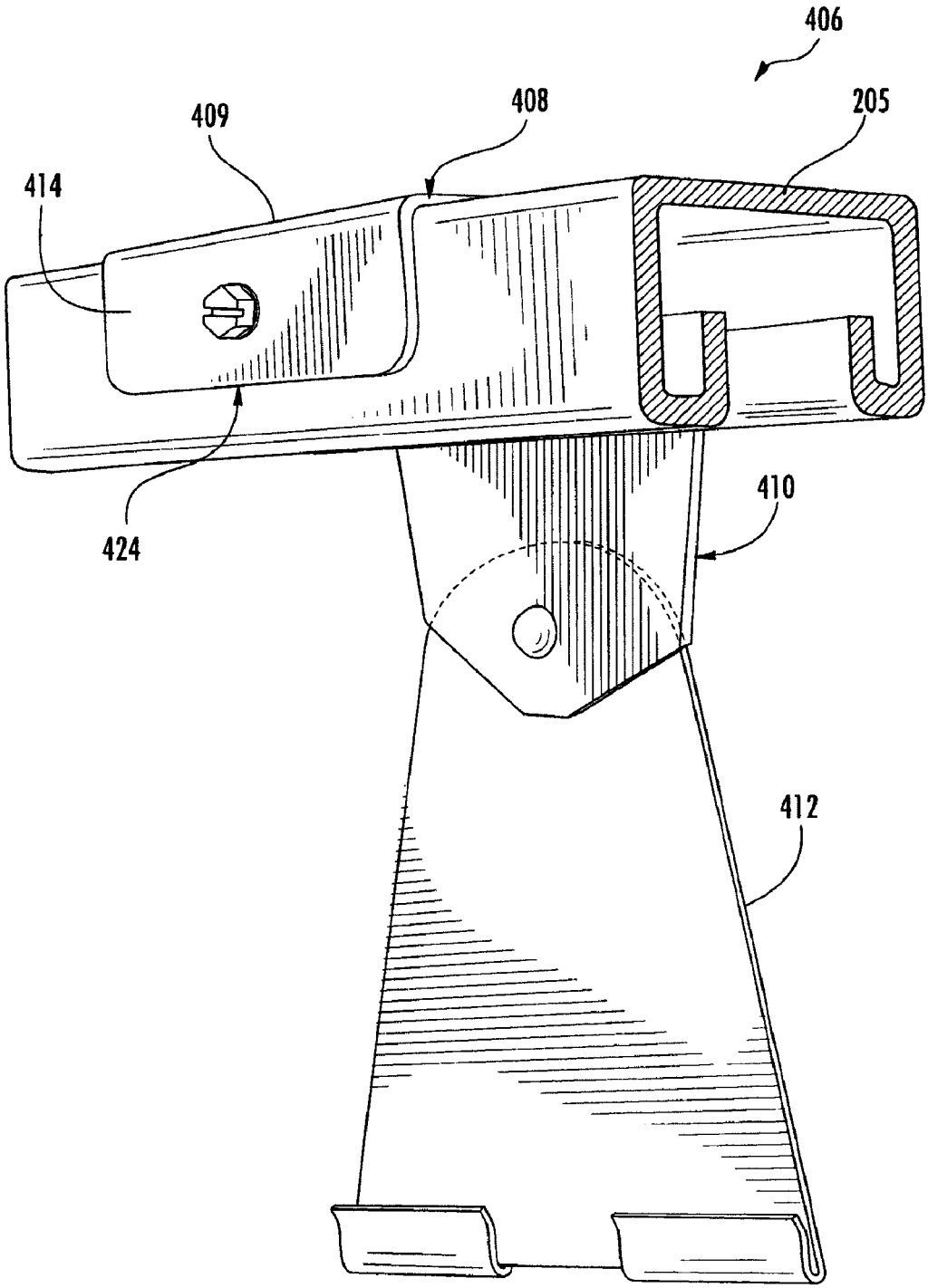
FIG. 14 is a perspective view of another embodiment of a bracket assembly constructed in accordance with the present invention shown connected to a strut.
Figure 15:
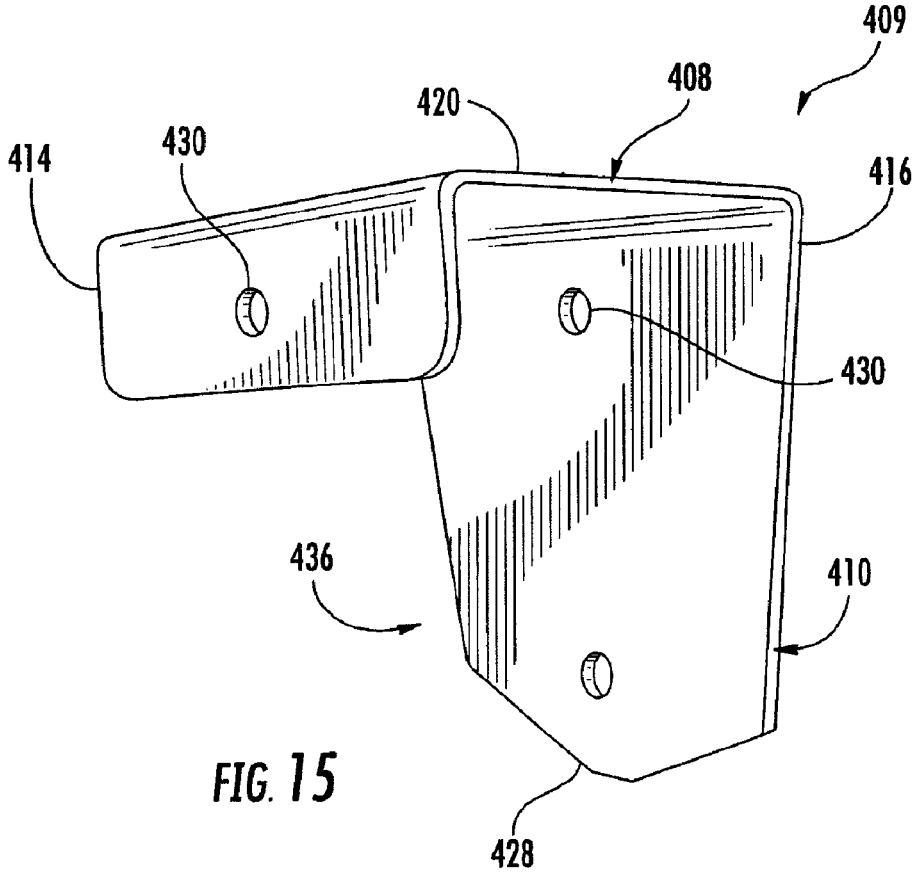
FIG. 15 is a perspective view of a connector member of the bracket assembly of FIG. 14.
Figure 16:
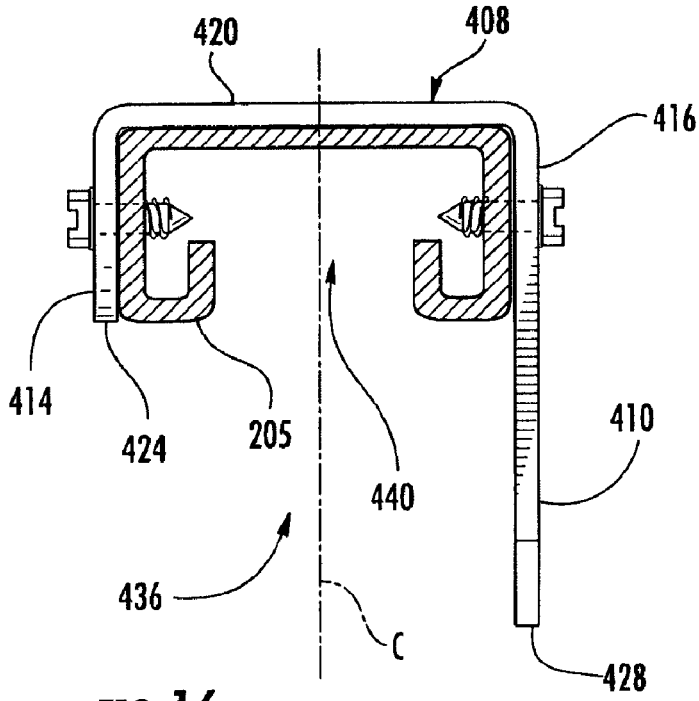
FIG. 16 is a side elevational of the connector member shown connected to the strut.

Referring now to FIGS. 7 and 8, the bar joist 204 is typically a component of a truss system for supporting the ceiling of the structure. The bar joist 204 may extend the length of the ceiling or may only extend partially along the ceiling. The bar joist 204 includes two support members 208 (best shown in FIG. 8) disposed in back-to-back relationship. Each of the support members 208 is shown to be substantially L-shaped to include a lower flange 210 and an upper flange 212 extending from the lower flange 210. The support members 208 are typically spaced from one another with a spacer 209 (see FIG. 10) and are joined together with a plurality of fasteners 214 (also see FIG. 10) inserted through the upper flanges 212 of the support members 208.

Like with the mounting bracket 10, the mounting bracket 200 may include one or more bracket assemblies 216. Because the bracket assemblies 216 are identical in construction, only one of the bracket assemblies 216 will be described in detail. The bracket assembly 216 includes a connector member 218 and hangar 222. The connector member 218 is designed to attach to at least one of the support members 208 of the bar joist 204. The connector member 218 may be fabricated from a strong and rigid material such as a metal (such as steel, titanium, aluminum or blends thereof), although any number of materials, for example, a resin or plastic polymer, natural material(s) such as a wood or fiber based material and combinations thereof, that would be known to one of ordinary skill in the art with the present disclosure before them are likewise contemplated for use in accordance with the present invention.

The connector member 218 has a mounting plate 226 and a hook portion 230 extending upwardly and inwardly from one end of the mounting plate 226. The connector member 218 can be joined to the support members 208 by the mounting plate 226. The mounting plate 226 may be sized to cover both of the lower flanges 210 of the support members 208 or only a portion of the lower flanges 210 of the support members 208. The mounting plate 226 is provided with a plurality of apertures 234 fabricated into the mounting plate 226 for securing the mounting plate 226 to one or both of the lower flanges 210 of the support members 208 in a manner to be described below.

The hook portion 230 extends from one end of the mounting plate 226 upwardly a distance and inwardly a distance from the end of the mounting plate 226 so as to cooperate with the mounting plate 226 to define a clip 228. The clip 228 is adapted to receive at least a portion of one of the lower flanges 210 of the support members 208 to permit the connector member 218 to be quickly and easily connected to the support member 208. In one embodiment, the retaining tab 230 includes a substantially arcuate portion 246 that curves inwardly towards the center of the mounting plate 226. Extending from the substantially arcuate portion 246 is a substantially concave portion 250 that includes a lower portion 254 spaced apart from the top surface of the mounting plate 226 at a predetermined distance which is preferably less than the thickness of the lower flanges 210 of the support members 208. Such a configuration allows the connector member 218 to be slidably disposed onto the lower flange 210 of one of the support members 208. The configuration also causes the lower portion 254 of the retaining tab 230 and the top surface of the mounting plate 226 to be able to exert compressive forces on the flange 210 of the support member 208 when the connector member 218 is clipped onto the lower flange 210 of the support member 208 to hold the connector member 218 to the lower flange 210 of the support member 208.

The connector member 218 also includes at least one flange 258 that extends from the mounting plate 226 in a downward direction. The flange 258 is shown extending from one end of the mounting plate 226, adjacent the end of the mounting plate 226 from which the hook portion 230 extends. The flange 258 includes an aperture 262 for receiving a fastener 266 for joining the hangar 222 to the connector member 218. The hangar 222 may be pivotally connected to the downward extending flange 258 or may be fixed to the mounting plate 226.

After the connector member 218 has been clipped to the support member 208, the connector member 218 may be fixed to the support member 208 with at least one fastener 238 inserted through the apertures 234 of the mounting plate 226.

In one embodiment, the hangar 222 is designed identically to the hangar 56 described above. However, it will be understood that the design of the hangar 56 is not limited to connecting to lighting fixtures only, but it may be modified to connect to any number of different objects, such as signage, advertisements, surveillance devices, and the like, in order to suspend such objects from the bar joist 204 of a ceiling of a structure.

Referring now to FIGS. 7 and 11-13, the mounting bracket 300 is for suspending an object, such as a lighting fixture or signage from the strut 205 of a ceiling of a structure. The mounting bracket 300 is provided for suspending an object in parallel relation to the strut 205. The mounting bracket 300 may include one or more bracket assemblies 306. For applications requiring two or more bracket assemblies 306, each of the bracket assemblies 306 are disposed along the same strut 205. Because the bracket assemblies 306 are identical in construction, only one of the bracket assemblies 306 will be described in detail. Each of the bracket assemblies 306 includes a connector member 309 and a hangar 312.

The connector member 309 is a unitary piece of material having a hook portion 308 and a flange 310. The connector member 309 is fabricated from a strong and rigid material such as a metal (such as steel, titanium, aluminum or blends thereof), although any number of materials, for example, a resin or plastic polymer, natural material(s) such as a wood or fiber based material and combinations thereof, that would be known to one of ordinary skill in the art with the present disclosure before them are likewise contemplated for use in accordance with the present invention. It will be understood that the hook portion 308 and the flange 310 are fabricated from a substantially flat piece of material (e.g., sheet metal) such that when the connector member 309 is joined to the strut 205 the hook portion 308 and flange 310 extend perpendicularly away from the strut 205. More specifically, both the hook portion 308 and the flange 310 of the connector member 309 have a flat or planar configuration and are arranged in a co-planar relationship. The flat shape of the connector member 309 allows for the connector member 309 to be installed in locations with tight lateral tolerances.

The hook portion 308 is configured to matingly overlap the strut 205 when the connector member 309 is mounted to the strut 205. More specifically, the hook portion 308 is fabricated having two vertical portions 314 and 316 which are spaced apart from one another by a substantially horizontal portion 320. The vertical portion 314 operates to securely connect the hook portion 308 to the strut 205. The vertical portion 314 has a length which can vary according to design requirements (e.g., the size and/or shape of the strut 205), and which terminates at an end 324. The vertical portion 314 covers at least a portion of the edge of the strut 205 opposite the vertical portion 316 when the connector member 309 is joined to the strut 205.

The flange 310 extends downwardly from the vertical portion 316 and inwardly a distance. The flange 310 provides a connection point for attaching the hangar 312. The flange 310 has a length which terminates at an end 328 and an aperture 332 that is preferably positioned such that when the hangar 312 is pivotally connected to the flange 310, the hangar 312 is vertically aligned with the longitudinal axis C of the strut 205 when bracket assembly 306 is mounted to the strut 205.

The end 328 of the flange 310 and the end 324 of the vertical portion 314 of the hook portion are spaced apart from one another to define an access passage 336 for receiving the strut 205. The hook portion 308 and flange 310 of the connector member 309 cooperate to define an interior space 340 which is sized such that the hook portion 308 may matingly overlap the strut 205 when the connector member 309 is mounted to the strut 205.

It will be understood that because the connector member 309 can be securely connected to the strut 205 without permanent attachment, allowing the connector member 309 to selectively move longitudinally along the strut 205, the installation of objects such as lighting fixtures is improved. For example, in cases where two bracket assemblies 306 are required, the movability of the connector members 309 after mounting to the strut 205 allows for simple adjustments to the overall space between the connector members 309 to accommodate the length of different lighting fixtures. Furthermore, the movability of the connector members 309 allows for the lighting fixture, or other object, to be selectively positionable along the strut 205 after the bracket assemblies 306 are mounted to the object.

The aperture 332 of the flange 310 receives a fastener that pivotally connects the hangar 312 to the flange 310. It will be understood that because the hangar 312 is pivotally connected to the flange 310, the hangar 312, or an object connected to the hangar 312 is able to self-level. It will further be understood that the hangar 312 can be fixed to the flange 310 rather than pivotally connected.

While the connector member 309 can be selectively positioned along the strut 205, some installations may require that the connector member 309 be securely attach to the strut 205. Therefore, the connector member 309 may include at least one tab 344 extending perpendicularly from at least one or both of the vertical portions 314 and 316 of the hook portion 308. The tabs 344 may extend perpendicularly from the vertical portions 314 and 316 so as to be positioned in a parallel relationship to a portion of the strut 205 when the connector member 309 is mounted to the strut 205. The tabs 344 are connected to the strut 205 via screws 348, although any number of methods for connecting the tabs 344 to the strut 205 which would be known to one of ordinary skill in the art such as rivets, pins, clips, adhesives, welding, and the like, are also likewise contemplated for use in accordance with the present invention.

The hangar 312 is designed identically to the hangar 56 described above. However, the design of the hangar 56 is not limited to connecting to lighting fixtures only, but may be modified to connect to any number of different objects, such as signage, advertisements, surveillance devices, and the like, in order to suspend such objects from the strut 205.

Referring now to FIGS. 7 and 14-16, the mounting bracket 400 is provided for suspending an object such as a lighting fixture or signage from the strut 205. More specifically, the mounting bracket 400 is provided for suspending an object between two struts 205. The mounting bracket 400 may include one or more bracket assemblies 406. For applications requiring two or more bracket assemblies 406, each of the bracket assemblies 406 are mounted on different struts 205. Because the bracket assemblies 406 are identical in construction, only one of the bracket assemblies 406 will be described in detail. Each of the bracket assemblies 406 includes a connector member 409 and a hangar 412.

The connector member 409 is a unitary piece of material shaped having a hook portion 408 and a flange 410. The connector member 409 is fabricated from a strong and rigid material such as a metal (such as steel, titanium, aluminum or blends thereof), although any number of materials, for example, a resin or plastic polymer, natural material(s) such as a wood or fiber based material and combinations thereof, that would be known to one of ordinary skill in the art with the present disclosure before them are likewise contemplated for use in accordance with the present invention. In contrast to the mounting bracket 300 described above, the hook portion 408 and the flange 410 are fabricated such that when the connector member 409 is mounted to the strut 205, the hook portion 408 and flange 410 extend longitudinally along the strut 205.

The hook portion 408 is configured to matingly overlap the strut 205 when the connector member 409 is mounted to the strut 205. More specifically, the hook portion 408 is fabricated having two vertical portions 414 and 416 which are spaced apart from one another by a substantially horizontal portion 420. The vertical portion 414 functions to securely connect the hook portion 408 to the strut 205. The vertical portion 414 has a length which will vary according to design requirements (e.g., the size and/or shape of the strut 205), and which terminates at an end 424. The vertical portion 414 to covers at least a portion of the edge of the strut 205 opposite the vertical portion 416 when the connector member 409 is mounted to the strut 205. Additionally, the vertical portions 414 and 416 each include an aperture 430 for attaching the connector member 409 to the strut 205 in a manner to be described below.

The flange 410 extends downwardly from the vertical portion 416 and includes an end 428 and an aperture 432 positioned along the length of the flange 410. In contrast to the mounting bracket 300 described above, the aperture 432 is transversely positioned relative to the longitudinal axis C of the strut 205 (see FIG. 16) rather than vertically aligned with the longitudinal axis C of the strut 205. The aperture 432 is provided for receiving a fastener that pivotally connects the hangar 412 to the flange 410. It will be understood that because the hangar 412 is pivotally connected to the flange 410, the hangar 412, or an object connected to the hangar 412 is able to self-level. It will be understood that although the hangar 412 has been disclosed as being pivotally connected to the flange 410, the hangar 412 may be fixed to the flange 410.

The end 428 of the flange 410 and the end 424 of the vertical portion 412 of the hook portion 408 are spaced apart from one another to define an access passage 436 providing a path to an interior space 440 defined by the hook portion 408 and the flange 410. The access passage 436 is sized to allow the strut 205 to be received within the interior space 440 of the mounting bracket 400. The interior space 440 is sized such that the hook portion 408 may matingly overlap the strut 205 when the connector member 409 is mounted to the strut 205.

It will be understood that because the connector member 409 can be securely mounted to the strut 205 without permanent attachment, allowing the connector member 409 to selectively move longitudinally along the strut 205, the installation of objects such as lighting fixtures is improved. For example, in cases where two bracket assemblies 406 are required, the movability of the connector members 409 after mounting to the struts 205 allows for precise linear alignment of the connector members 409 mounted on separate struts 205. Furthermore, the movability of the connector members 409 allows for the lighting fixture, or other object, to be selectively positioned along the struts 205 after the bracket assemblies 406 are mounted to the lighting fixture.

While the connector member 409 can be selectively positioned along the strut 205, some installations may require that the connector member 409 be securely attach to the strut 205. Therefore, the apertures 430 of the vertical portions 414 and 416 of the hook portion 408 are configured to receive a fastener such as a screw for securing the connector member 409 to the strut 205. Moreover, any number of methods for connecting the vertical portions 414 and 416 of the hook portion 408 to the strut 205 which would be known to one of ordinary skill in the art such as rivets, pins, clips, adhesives, welding, and the like, are also likewise contemplated for use in accordance with the present invention.

Additionally, the hangar 412 is designed identically to the hangar 56 described above. However, it will be understood that the design of the hangar 56 is not limited to connecting to lighting fixtures only, but may be modified to connect to any number of different objects, such as signage, advertisements, surveillance devices, and the like, in order to suspend such objects from the strut 205 of a ceiling of a structure.

Figure 17:
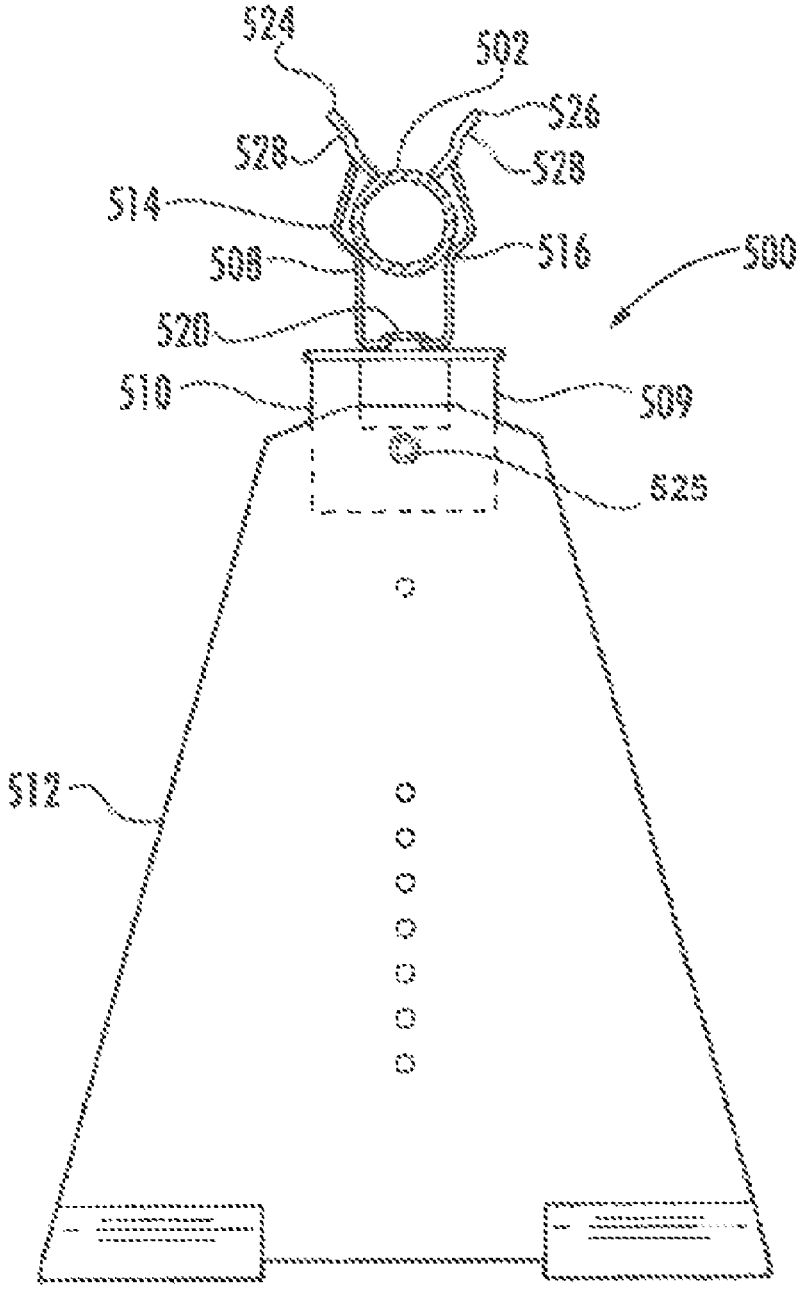
FIG. 17 is an end view of another embodiment of a bracket assembly constructed in accordance with the present invention shown connected to a pipe.

Referring now to FIG. 17, shown is another embodiment of a mounting bracket assembly 500 for suspending an object, such as a lighting fixture or signage from a pipe 502 supported by a ceiling of a structure. The pipe 502 may be supported in any fashion, such as positioning the pipe 502 across adjacent bar joists. The mounting bracket assembly 500 may be used alone or in combination with one or more additional bracket assemblies 500. For applications requiring two or more bracket assemblies 500, each of the bracket assemblies 500 is disposed along the same pipe 502 or they may be disposed along different pipes. Each bracket assembly 500 includes a connector member 509 and a hangar 512.

The connector member 509 has clip portion 508 and a flange 510. The connector member 509 is fabricated from a strong and rigid material such as a metal (such as steel, titanium, aluminum or blends thereof), although any number of materials, for example, a resin or plastic polymer, natural material(s) such as a wood or fiber based material and combinations thereof, that would be known to one of ordinary skill in the art with the present disclosure before them are likewise contemplated for use in accordance with the present invention.

The clip portion 508 is configured to snap onto the pipe 502. More specifically, the clip portion 508 is fabricated having two vertical portions 514 and 516 which are spaced apart from one another by a substantially horizontal portion 520. The vertical portions 514 and 516 are outwardly flexible and operate to securely connect the clip portion 508 to the pipe 502. The vertical portions 514 and 516 have lengths which can vary according to design requirements (e.g., the size and/or shape of the pipe 502), and which terminate at ends 524 and 526. The end 524 and 526 may be provided with tines 528 which are oriented to bite or grab the pipe 502. An example of a suitable clip portion is the clip that is provided on the metal deck conduit support available from Erico International Co., part number AOL8P.

The flange 510 extends downwardly from the horizontal portion 520. The flange 510 has an aperture (not shown) to provide a connection point for attaching the hangar 512. The aperture 522 of the flange 510 receives a fastener 525 that pivotally connects the hangar 512 to the flange 510. It will be understood that because the hangar 512 is pivotally connected to the flange 510, the hangar 512, or an object connected to the hangar 512 is able to self-level. It will further be understood that the hangar 512 can be fixed to the flange 510 rather than pivotally connected.

The hangar 512 is designed substantially identically to the hangar 56 described above. However, the design of the hangar 56 is not limited to connecting to lighting fixtures only, but may be modified to connect to any number of different objects, such as signage, advertisements, surveillance devices, and the like, in order to suspend such objects from the pipe 502.

Figure 18:
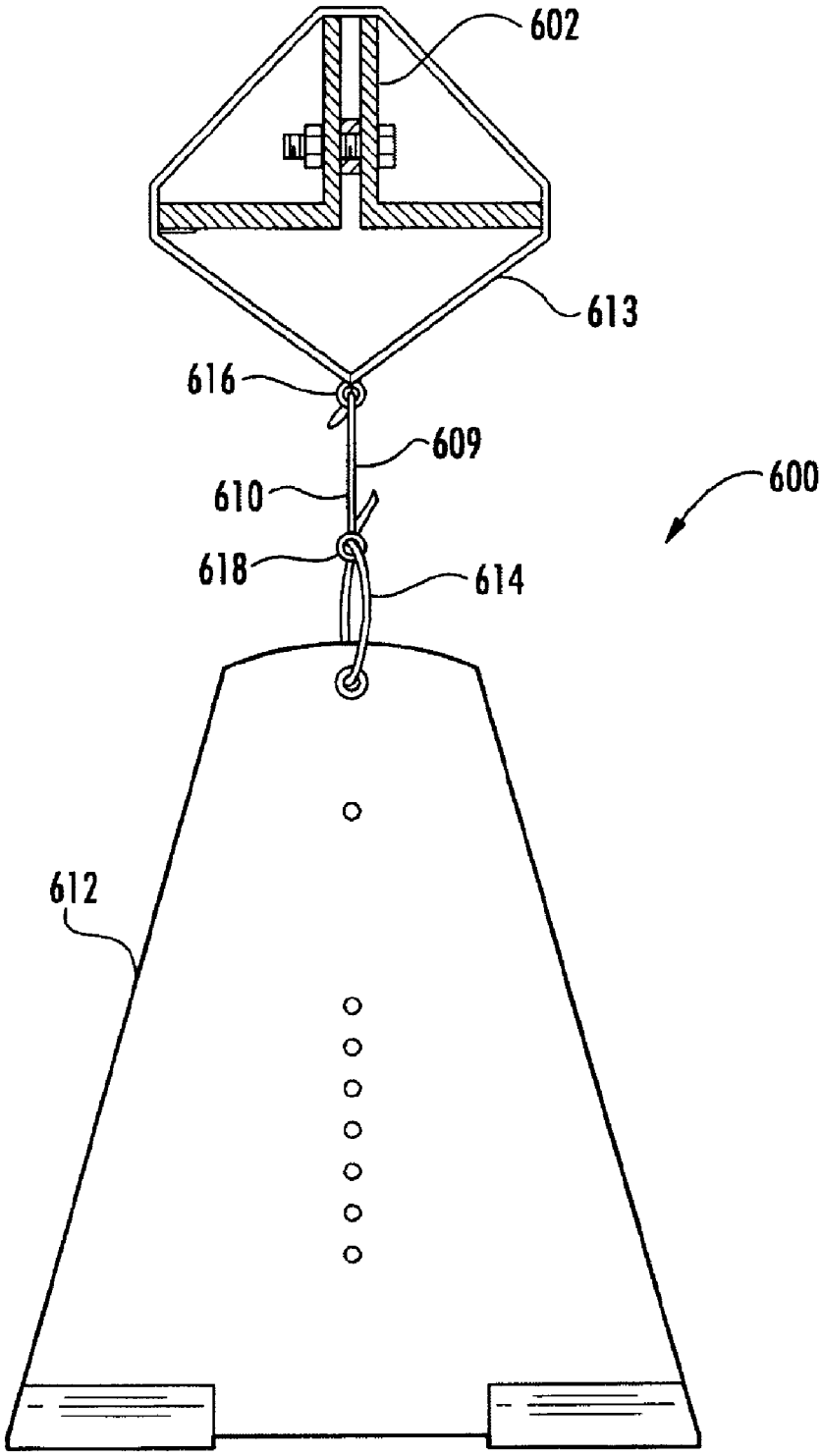
FIG. 18 is an end view of another embodiment of a bracket assembly constructed in accordance with the present invention shown connected to a bar joist.

Referring now to FIG. 18, shown is another embodiment of a mounting bracket assembly 600 for suspending an object, such as a lighting fixture or signage from a ceiling of a structure. The mounting bracket assembly 600 is shown connected to a bar joist 602 in FIG. 18. However, it should be appreciated that the mounting bracket assembly 600 is adapted to suspend objects from structures that include bar joists, struts, pipes and a variety of other structures. It will also be appreciated that one or more mounting bracket assemblies 600 may be used depending on the application. The mounting bracket assembly 600 includes a connector member 609 and a hangar 612.

The connector member 609 is a flexible cable 610. The flexible cable 610 may be fabricated from any suitable material such as steel, aluminum, or polymeric materials.

The cable 610 is shown to include a first loop 613 and a second loop 614. The first loop 612 is formed about the bar joist 602 and secured thereabout with a connector 616. The second loop 614 is formed through the hanger 612 and secured thereabout with a connector 618 such that the hanger 612 is pivotally connected to the cable 610. It will be understood that because the hangar 612 is pivotally connected to the cable 610, the hangar 612, or an object connected to the hangar 612 is able to self-level. The second loop 614 may be formed at any orientation relative to the first loop 613. The second loop 614 is shown in FIG. 18 to be formed in a perpendicular relationship to the first loop 613 whereby the hanger 612 is suspended in a perpendicular relationship with respect to the bar joist 602.

The hangar 612 is designed substantially identically to the hangar 56 described above. However, the design of the hangar 56 is not limited to connecting to lighting fixtures only, but may be modified to connect to any number of different objects, such as signage, advertisements, surveillance devices, and the like, in order to suspend such objects from various ceiling structures.

Figure 19:
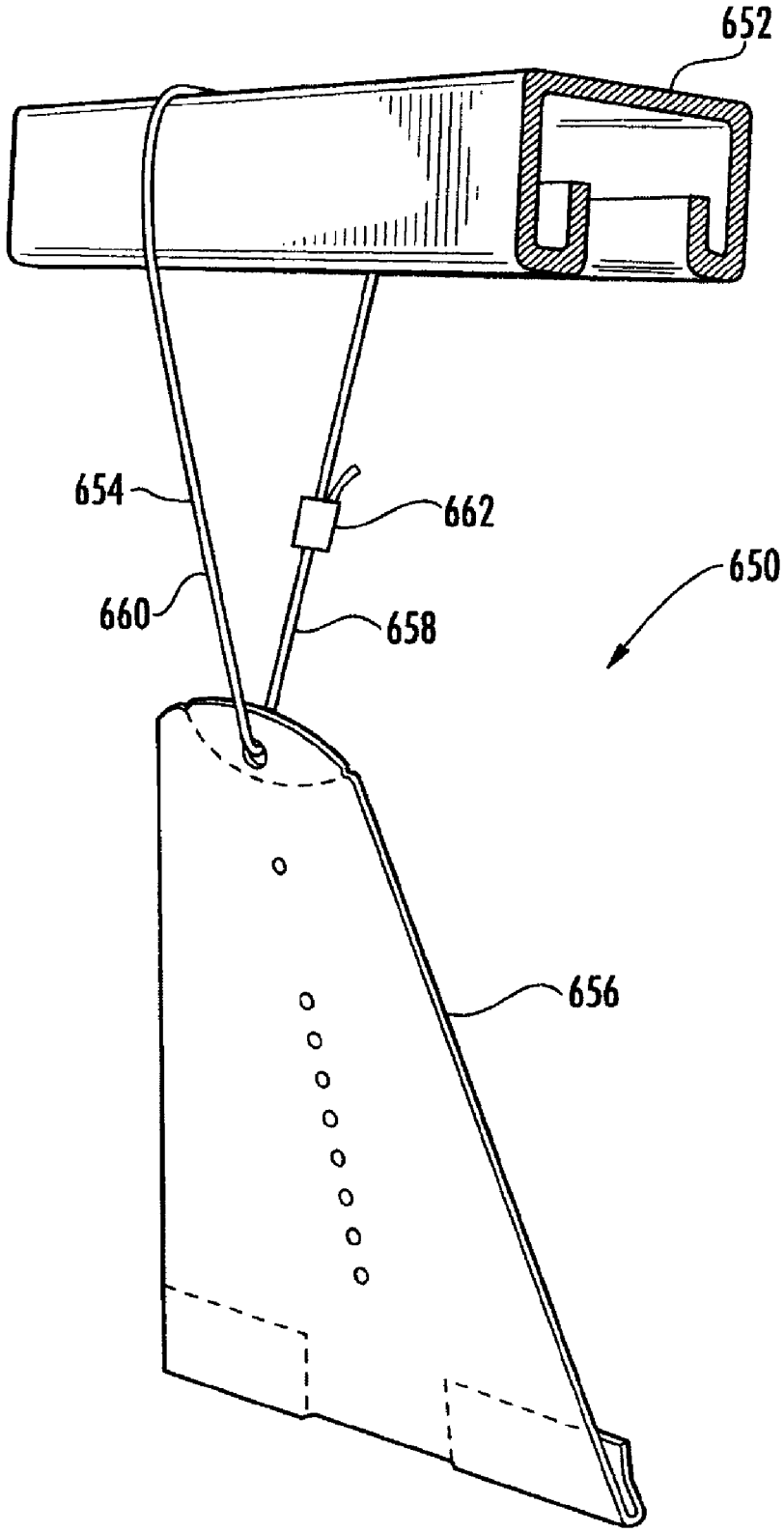
FIG. 19 is an end view of another embodiment of a bracket assembly constructed in accordance with the present invention shown connected to a bar joist.

FIG. 19 shows a mounting bracket assembly 650 for suspending an object, such as a lighting fixture or signage from a ceiling of a structure. The mounting bracket assembly 650 is shown connected to a strut 652 in FIG. 19. However, it should be appreciated that the mounting bracket assembly 650 is adapted to suspend objects from structures that include bar joists, struts, pipes and a variety of other structures. It will also be appreciated that one or more mounting bracket assemblies 650 may be used depending on the application. The mounting bracket assembly 650 includes a connector member 654 and a hangar 656.

The connector member 654 is a flexible cable 658. The flexible cable 658 may be fabricated from any suitable material such as steel, aluminum, or polymeric materials. The cable 658 is shown to include a single loop 660 formed about the strut 652 and secured thereabout with a connector 662. The single loop 660 is also formed through the hanger 656 such that the hanger 612 is pivotally connected to the cable 658. It will be understood that because the hangar 612 is pivotally connected to the cable 658, the hangar 656, or an object connected to the hangar 612 is able to self-level.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes be made which will readily suggest themselves to those skilled in the art and which are accomplished within the spirit of the invention disclosed and as defined in the appended claims.

What is claimed is:

1. A bracket assembly for suspending an object from a portion of a bar joist, comprising:

a rigid hangar having a first end portion and an opposing second end portion, the second end portion including at least one connector for engaging the object; and a connector member having a hook portion configured to substantially conform to at least a portion of the bar joist and at least one flange extending downwardly from the hook portion, the rigid hanger being pivotally connected to the flange so that the object connected to the rigid hangar is able to self-level upon the connector member being connected to the bar joist.

2. The bracket assembly of claim 1, wherein the hook portion includes a horizontal mounting plate and a retaining tab extending upwardly and inwardly from one end of the mounting plate, the mounting plate and retaining tab cooperating to define a clip such that the hook portion is slidably disposable over the bar joist with the retaining tab and the mounting plate cooperating to exert compressive forces on the bar joist to secure the connector member to the bar joist.

3. The bracket assembly of claim 2, wherein the flange of the connector member extends from an end of the mounting plate adjacent the end of the mounting plate from which the retaining tab extends.

4. The bracket assembly of claim 2, further comprising means for securing the connector member to the bar joist.

5. The bracket assembly of claim 1, wherein the flange is planar, wherein the hook portion is planar, and wherein the flange and the hook portion are configured in a co-planar relationship.

6. The bracket assembly of claim 5, wherein the bar joist includes a strut, and wherein the hook portion is configured to matingly overlap at least portion of the strut.

7. The bracket assembly of claim 5, wherein the pivotal connection between the connector member and the hangar is vertically aligned with the longitudinal axis of the strut when the bracket assembly is mounted to the strut.

8. The bracket assembly of claim 5, further comprising a tab extending perpendicularly from the hook portion so as to be positionable in a parallel relationship to an adjacent face of the strut when the bracket assembly is mounted to the strut; and means for securing the tab to the strut to secure the connector member to the strut.

9. A mounting bracket for suspending a lighting fixture from a portion of a bar joist, the lighting fixture comprising a frame having a first and second ends, the bracket assembly comprising:

two bracket assemblies, each bracket assembly comprising:

a rigid hangar having a first end portion and an opposing second end portion, the second end portion including at least one connector for engaging one of the first end and the second end of the frame of the lighting fixture; and a connector member having a hook portion configured to substantially conform to at least a portion of the bar joist and at least one flange extending downwardly from the hook portion, the right hanger being pivotally connected to the flange, wherein the mounting bracket when connected to the lighting fixture and the bar joist allow the lighting fixture to self-level.

10. The mounting bracket of claim 9, wherein the hook portion includes a horizontal mounting plate and a retaining tab extending upwardly and inwardly from one end of the mounting plate, the mounting plate and retaining tab cooperating to define a clip such that the hook portion is slidably disposable over the bar joist with the retaining tab and the mounting plate cooperating to exert compressive forces on the bar joist to secure the connector member to the bar joist.

11. The mounting bracket of claim 10, wherein the flange of the connector member extends from an end of the mounting plate adjacent the end of the mounting plate from which the retaining tab extends.

12. The mounting bracket of claim 10, further comprising means for securing the mounting plate to the bar joist to secure the connector member to the bar joist.

13. The mounting bracket of claim 9, wherein the flange is planar, wherein the hook portion is planar, and wherein the flange and the hook portion are configured in a co-planar relationship.

14. The mounting bracket of claim 13, wherein the bar joist includes a strut, and wherein the hook portion is configured to matingly overlap at least portion of the strut.

15. The mounting bracket of claim 13, wherein the pivotal connection between the connector member and the hangar is vertically aligned with the longitudinal axis of the strut when the bracket assemblies are mounted to the strut.

16. The mounting bracket of claim 13, further comprising:

a tab extending perpendicularly from the hook portion so as to be positionable in a parallel relationship to a portion of the strut when the bracket assemblies are mounted to the strut; and means for securing the tab to the strut to secure the connector member to the strut.

* * * * *